US006378150B1

(12) United States Patent
Minegishi et al.

(10) Patent No.: US 6,378,150 B1
(45) Date of Patent: Apr. 30, 2002

(54) CUSHION MEMBER, METHOD AND APPARATUS FOR MANUFACTURING THE SAME

(75) Inventors: Takeshi Minegishi; Takashi Ebihara, both of Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 0 days.

(21) Appl. No.: 09/673,158

(22) PCT Filed: Feb. 23, 2000

(86) PCT No.: PCT/JP00/01038

§ 371 Date: Oct. 10, 2000

§ 102(e) Date: Oct. 10, 2000

(87) PCT Pub. No.: WO00/50681

PCT Pub. Date: Aug. 31, 2000

(30) Foreign Application Priority Data

Feb. 25, 1999 (JP) ..... 11-048010

(51) Int. Cl.[7] ..... A47C 16/00

(52) U.S. Cl. ..... 5/652.1; 5/652; 5/953

(58) Field of Search ..... 264/441, 177.13, 264/211.14; 425/110; 156/272.2, 274.6, 167, 500; 428/71, 373, 221; 5/652.1, 655.9, 740, 652, 953, 724

(56) References Cited

U.S. PATENT DOCUMENTS

| | | | | |
|---|---|---|---|---|
| 3,687,759 A | | 8/1972 | Elsenfeld et al. | |
| 4,818,324 A | * | 4/1989 | David | 156/292 |
| 4,913,757 A | | 4/1990 | Yamanaka et al. | |
| 4,952,265 A | | 8/1990 | Yamanaka et al. | |
| 5,087,499 A | * | 2/1992 | Sullivan | 428/85 |
| 5,464,491 A | | 11/1995 | Yamanaka | |
| 5,486,411 A | * | 1/1996 | Hassenboehler et al. | 428/286 |
| 5,501,891 A | * | 3/1996 | Saika et al. | 428/71 |
| 5,639,543 A | | 6/1997 | Isoda et al. | |
| 5,683,811 A | * | 11/1997 | Hernandez et al. | 428/373 |
| 6,131,220 A | * | 10/2000 | Morimura | 5/652.1 |
| 6,196,156 B1 | * | 3/2001 | Denesuk et al. | 5/636 |

FOREIGN PATENT DOCUMENTS

| | | |
|---|---|---|
| GB | 2 251 255 A | 7/1992 |
| WO | WO 95/33610 | 12/1995 |

* cited by examiner

*Primary Examiner*—Lynne H. Browne
*Assistant Examiner*—Fredrick Conley
(74) *Attorney, Agent, or Firm*—Frishauf, Holtz, Goodman, Langer & Chick, P.C.

(57) ABSTRACT

A cushion manufacturing apparatus comprises a plurality of nozzles for continuously discharging a softened thermoplastic resin, thereby looping a plurality of continuous filaments with the respective contact portions thereof bonded together, first guide portions (41, 42) for moving the continuous filaments inward from opposite surfaces in the thickness direction of the cushion member as the filaments are looped, and second guide portions (43, 44) for moving the filaments inward from the opposite sides of the cushion member. The guide portions (41, 42; 43, 44) are provided with a plurality of rollers (50, 52, 60, 62) individually having outer peripheral surfaces projected or recessed corresponding to the outline of the profile of the cushion member and belts (54, 55, 64, 65) stretched between the rollers and capable of endlessly running to change the respective shapes thereof depending on the respective shapes of the outer peripheral surfaces of the rollers, thereby forming the shaping guide surfaces (56, 57, 66, 67).

13 Claims, 10 Drawing Sheets

CUSHION MEMBER, METHOD AND APPARATUS FOR MANUFACTURING THE SAME

TECHNICAL FIELD

The present invention relates to cushion members adapted for use in seats of vehicles, such as automobiles, vessels, aircraft, etc., or in some pieces of furniture, such as sofas, beds, etc., and a method and an apparatus for manufacturing the same.

BACKGROUND ART

Conventionally, synthetic resin foam, such as polyurethane foam, has been used for many of cushion members that are employed in seats of vehicles, for example. Described in U.S. Pat. No. 5,639,543 is a cushion member with a three-dimensional network structure that is formed of a thermoplastic resin. This cushion member has been proposed to ensure higher breathability or to facilitate re-fusion for recycling.

In order to manufacture the cushion member with the network structure, a large number of continuous fibers that can be obtained by discharging a molten thermoplastic resin through a number of nozzles are guided between a pair of flat conveyor belts, right and left, into a cooling tank. A cushion member (network block) in the shape of a rectangular parallelepiped can be obtained by looping these continuous filaments in the cooling tank and bonding the respective contact portions of the resulting loops.

In order to give a desired cushion member shape to the network block, the block is put in a forming mold and hot-pressed, conventionally. By this hot pressing, the network block is compressed so that its volume is substantially halved, and is molded into the desired shape. Thereupon, the cushion member can acquire its final product shape.

In the case where the network block is compressed by hot pressing, its apparent density (or weight) increases unduly. Further, this block forming method requires many man-hours and long operating time, thus entailing high cost.

DISCLOSURE OF INVENTION

Accordingly, the object of the present invention is to provide a cushion member and an apparatus for manufacturing the same, whereby a cushion member having a three-dimensional network structure with a desired shape can be manufactured efficiently without entailing substantial compression.

In order to achieve the above object, a cushion member according to the present invention comprises a three-dimensional network structure with an apparent density of 0.005 to 0.20 g/cm$^3$, formed by looping a plurality of continuous filaments of a thermoplastic resin with fineness of 300 to 100,000 deniers and bonding the respective contact portions of the filaments, the network structure being solidified in a manner such that the continuous filaments are moved inward from opposite surfaces in the thickness direction of the cushion member to be formed and from opposite sides, depending on the product shape of the cushion member, as the continuous filaments are looped.

The cushion member of the invention constructed in this manner does not require use of a binder and is formed of thermoplastic resin (preferably, thermoplastic elastic resin), so that it can be refused to be recycled. As the continuous filaments are delivered from nozzles and looped, the cushion member acquires a shape that resembles its final product shape. Thus, the product shape can be obtained without requiring substantial compression, so that the density of the structure cannot be too high to secure lightness in weight. The cushion member of the invention has high breathability and fatigue resistance, and can be finished with a low degree of compression for secondary forming, so that it is light in weight. Since the continuous filaments are looped between the opposite sides of the cushion member, moreover, the cushion member can enjoy better cushioning characteristics.

A manufacturing method for a cushion member according to the invention comprises a process for discharging a softened thermoplastic resin through a plurality of nozzles, thereby looping a plurality of continuous filaments and bonding the respective contact portions of the filaments, and a process for solidifying the continuous filaments in a manner such that the filaments are moved inward from opposite surfaces in the thickness direction of the cushion member to be formed and from opposite sides by means of guide means having shaping guide surfaces corresponding to the outline of the profile of the cushion member as the filaments are looped. This manufacturing method lowers or obviates the necessity of a post-process (secondary forming process), such as a compression process, for giving the final product shape to the cushion member. According to this manufacturing method, the three-dimensional cushion member with a network structure can be continuously manufactured with high efficiency, and the final product shape can be finished without requiring substantial compression for secondary forming. In some cases, the secondary forming process can be omitted. Accordingly, the manufacturing cost can be lowered, and a cushion member with high durability and breathability can be obtained without suffering too high a density.

The manufacturing method of the invention may further comprise a process for additionally forming the cushion member in a manner such that the cushion member is held from both sides thereof by means of a secondary forming mold while the temperature of the cushion member, delivered continuously from the guide means, is within a range for thermal deformation. The secondary forming operation can accurately finish the cushion member in its final product shape. Since the cushion member can be preformed into a shape that resembles the shape of a finished product before it is secondary formed, moreover, the secondary forming operation requires only a low degree of compression.

A cushion manufacturing apparatus according to the invention comprises a nozzle portion having a plurality of nozzles for continuously discharging a softened thermoplastic resin, whereby a plurality of continuous filaments discharged from the nozzles are looped with the respective contact portions thereof bonded together, guide means located under the nozzle portion and having shaping guide surfaces corresponding to the outline of the profile of the cushion member to be formed, the guide means serving to move the continuous filaments inward from opposite surfaces in the thickness direction of the cushion member and from opposite sides as the filaments are looped, and cooling means for cooling the continuous filaments, thereby solidifying the same. According to this manufacturing apparatus, the cushion member can be preformed as the continuous filaments are looped (or when the network structure is manufactured), the subsequent secondary forming process (for finishing into the final product shape) requires only a low degree of compression. Thus, the three-dimensional cushion member with a network structure can be continuously manufactured with high efficiency.

In the cushion manufacturing apparatus of the invention, the guide means may include a pair of first guide portions opposed individually to the thickness direction opposite surfaces of the cushion member to be formed and a pair of second guide members opposed to the opposite sides of the cushion member to be formed, the first and second guide portions including a plurality of rollers individually having outer peripheral surfaces corresponding to the outline of the profile of the cushion member and belts stretched between the rollers and capable of endlessly running to change the respective shapes thereof depending on the respective shapes of the outer peripheral surfaces of the rollers, thereby forming the shaping guide surfaces. With use of this guide means that holds the cushion member in the four directions, the unsolidified network structure can be preformed so that its shape resembles the final product shape of the cushion member. According to this manufacturing apparatus, the network structure is moved from the four sides by means of the first and second guide portions, so that it can be shaped further effectively.

In the cushion manufacturing apparatus of the invention, the guide means may include a pair of guide portions opposed to each other across the cushion member to be formed, the guide portions including a plurality of rollers individually having outer peripheral surfaces surrounding the thickness-direction opposite surfaces and the opposite sides of the cushion member and belts stretched between the rollers and capable of endlessly running to change the respective shapes thereof depending on the respective shapes of the outer peripheral surfaces of the rollers, thereby forming the shaping guide surfaces. Also with use of this guide means that holds the cushion member in the two directions, the unsolidified network structure can be formed so that its shape resembles the final product shape of the cushion member. According to this manufacturing apparatus, the number of rollers that constitute the guide means can be reduced.

In the cushion manufacturing apparatus of the invention, the guide means may be designed so that the distance of movement of the continuous filaments from the opposite sides is greater than the distance of movement in the thickness direction of the cushion member. According to this manufacturing apparatus, the continuous filaments can be looped in the thickness direction of the cushion member between the opposite sides thereof, so that the cushioning characteristics of the cushion member are improved.

The cushion manufacturing apparatus of the invention may further comprise a secondary forming mold for holding the cushion member from both sides thereof and additionally forming the cushion member while the temperature of the cushion member, delivered continuously from the guide means, is within a range for thermal deformation. The secondary forming mold used may be a simple mold such as a punching metal mold having a large number of through holes. According to this manufacturing apparatus, the cushion member that is continuously delivered from the guide means can be accurately finished into the product shape by means of the secondary forming mold.

In the cushion manufacturing apparatus of the invention, the nozzle portion may include masking means for covering some of the nozzles so that the resin is discharged into a region inside the shaping guide surfaces of the guide means. With use of the nozzle portion constructed in this manner, the distribution of the continuous filaments that are discharged from the nozzles can be made to resemble the profile of the cushion member to be shaped by means of the guide means. Thus, according to this manufacturing apparatus, the shaping effect of the guide means can be further improved. The masking means may be provided with movable masking members that can change the discharge region of the nozzle portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

BEST MODE FOR CARRYING OUT THE INVENTION

A first embodiment of the present invention will now be described with reference to the accompanying drawings of FIGS. 1 to 6.

Figure 2:
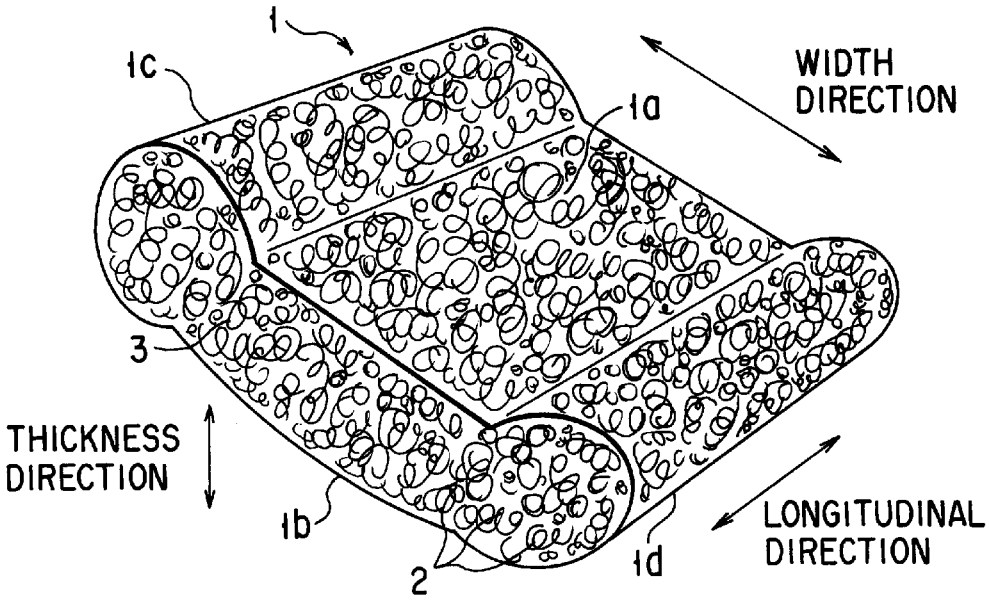
FIG. 2 is a perspective view of an example of a cushion member manufactured by using the guide means shown in FIG. 1.

A cushion member 1 shown in FIG. 2 is a three-dimensional network structure 3 that is formed by randomly looping continuous filaments 2 of 300 deniers or more, which are formed mainly of a thermoplastic elastic resin, and bonding the respective contact portions of the resulting loops. The apparent density of the cushion member 1 ranges from 0.005 to 0.20 g/cm$^3$. The continuous filaments 2 have a diameter of, for example, 0.3 mm to 0.4 mm. Nonetheless, the diameter is not limited to one in this range.

In the cushion member 1, as mentioned later, the continuous filaments 2 are looped and moved inward from opposite surfaces 1*a* and 1*b* in the thickness direction of the member 1 and inward from opposite sides 1*c* and 1*d*, depending on the profile of the member 1. Thus, the continuous filaments 2 are solidified in a manner such that the network structure 3 is moved inward in the thickness and width directions. In the case where the cushion member 1 is used for a seat of a vehicle or the like, the flat surface (top surface) 1*a* in the thickness direction serves as a seat cushion that mainly receives a seater's load. The swollen sides 1*c* and 1*d* function as so-called side support portions.

If its apparent density is less than 0.005 g/cm$^3$, the cushion member 1 cannot enjoy repulsive force, so that it is not suited for use as cushion means. If the apparent density exceeds 0.20 g/cm$^3$, the resiliency of the cushion member 1 is too high to ensure comfortable seating, so that the member 1 is not suited for the purpose either. Preferably, the apparent density of the cushion member 1 ranges from 0.01 g/cm$^3$ to 0.05 g/cm$^3$.

If the fineness of the continuous filaments 2 is less than 300 deniers, the strength and repulsive force lower inevitably. If the fineness exceeds 100,000 deniers, the number of filament 2 per unit volume is reduced, so that the compression characteristics worsen. Thus, the fineness of the filaments 2 should be adjusted to 300 deniers or more, preferably to 400 to 100,000 deniers, and further preferably to 500 to 50,000 deniers, in order to ensure satisfactory repulsive force for the cushion member.

Polyester-based elastomer, polyamide-based elastomer, or polyurethane-base elastomer may be used as the thermoplastic elastic resin for the continuous filaments 2. The polyester-based elastomer may, for example, be a polyester-ether block copolymer that is based on thermoplastic polyester as a hard segment and polyalkylene diol as a soft segment or a polyester-ether block copolymer that is based on aliphatic polyester as a soft segment. The polyamide-based elastomer may be a material that is based on nylon as a hard segment and polyethylene glycol or polypropylene glycol as a soft segment, for example.

The aforesaid thermoplastic elastic resins may be combined with a thermoplastic nonelastic resin. Polyester, polyamide, or polyurethane may be used as the thermoplastic nonelastic resin, for example. To facilitate recycling, the thermoplastic elastic and nonelastic resins to be combined with one another should preferably be selected among similar resins. Recommendable combinations include a combination of polyester-based elastomer and polyester resin, combination of polyamide-based elastomer and polyamide resin, combination of polyurethane-based elastomer and polyurethane resin, etc., for example.

Figure 3:
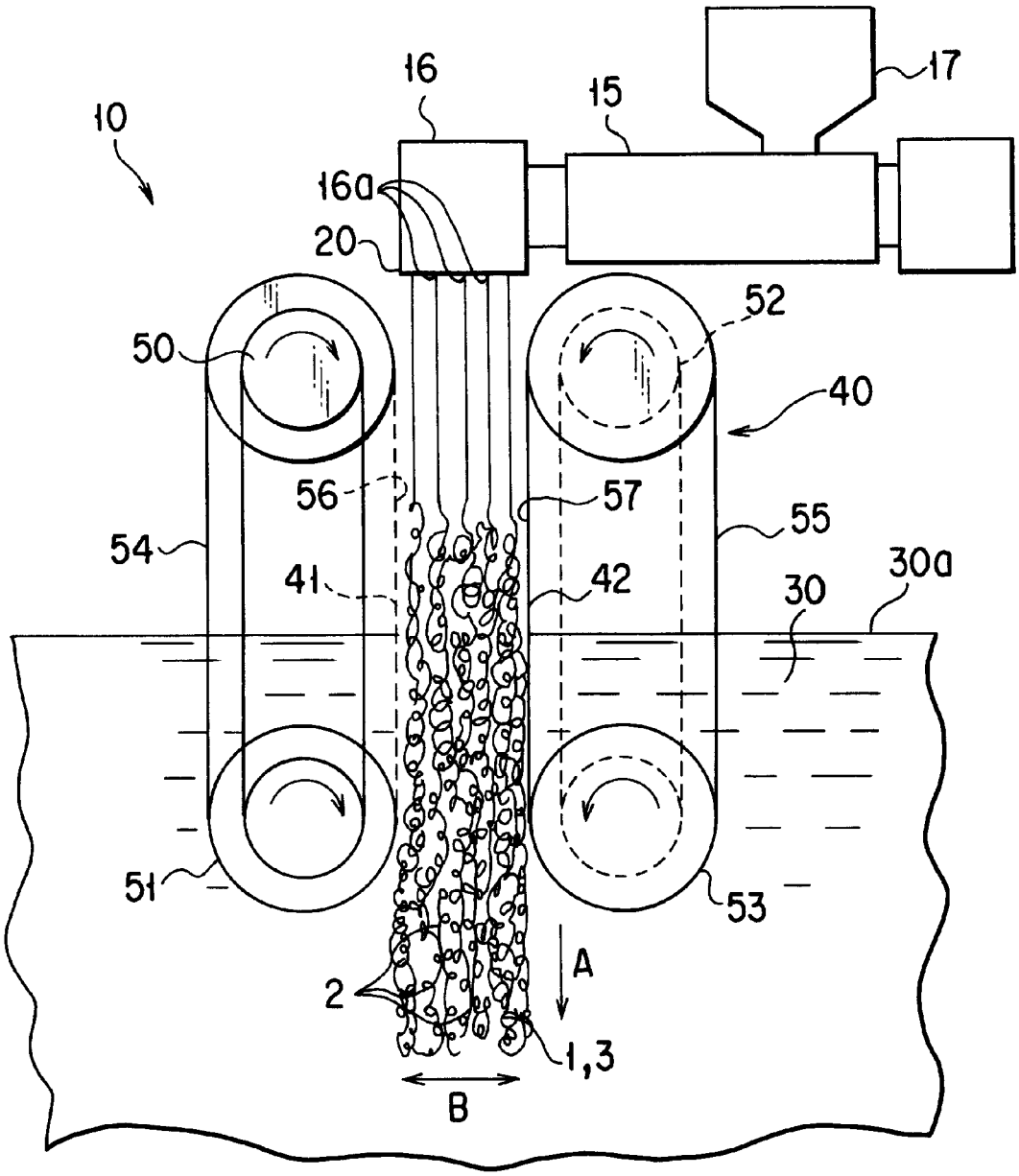
FIG. 3 is a side view of the cushion manufacturing apparatus furnished with the guide means shown in FIG. 1.

The cushion member 1 is manufactured by means of a cushion manufacturing apparatus 10 that is conceptually shown in FIG. 3. An example of the manufacturing apparatus 10 comprises an extruder 15 and a nozzle portion 16. The extruder 15 heats the thermoplastic elastic resin material, introduced through a material loading feeder port 17, to a temperature higher than the melting point of the resin by 10° C. to 80° C. (e.g., higher than 40° C.) as it extrudes the material toward the nozzle portion 16.

The thermoplastic elastic resin, heated to the aforesaid temperature, is discharged downward from the nozzle portion 16, and freely falls in a continuous line without a break. If the temperature at which the elastic resin melts as it is discharged is 30° C. to 50° C. higher than the melting point of the resin, three-dimensional random loops can be formed with ease, so that the respective contact portions of the loops can favorably be kept easily bondable.

Figure 4:
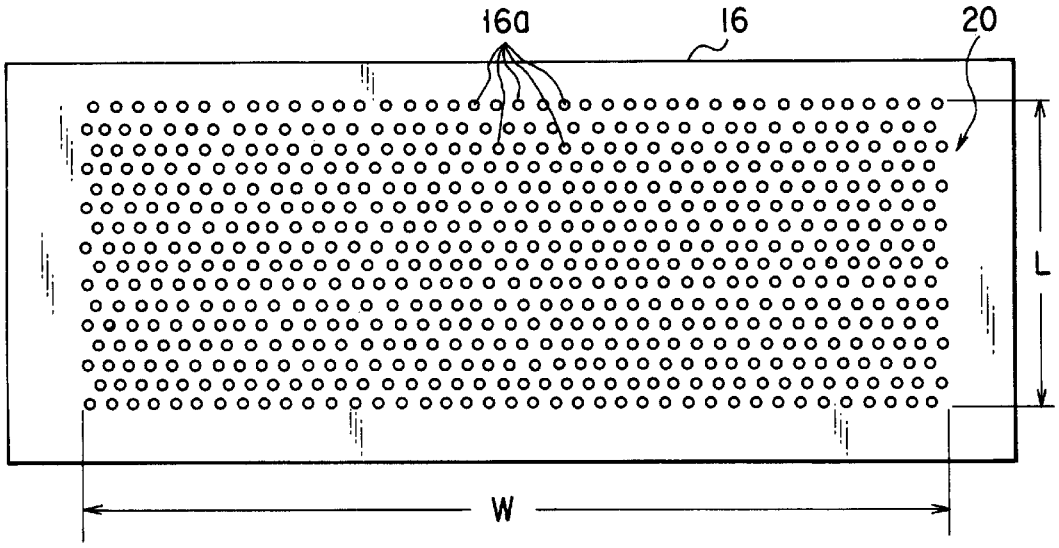
FIG. 4 is a plan view of a nozzle portion of the cushion manufacturing apparatus shown in FIG. 3.
Figure 5:
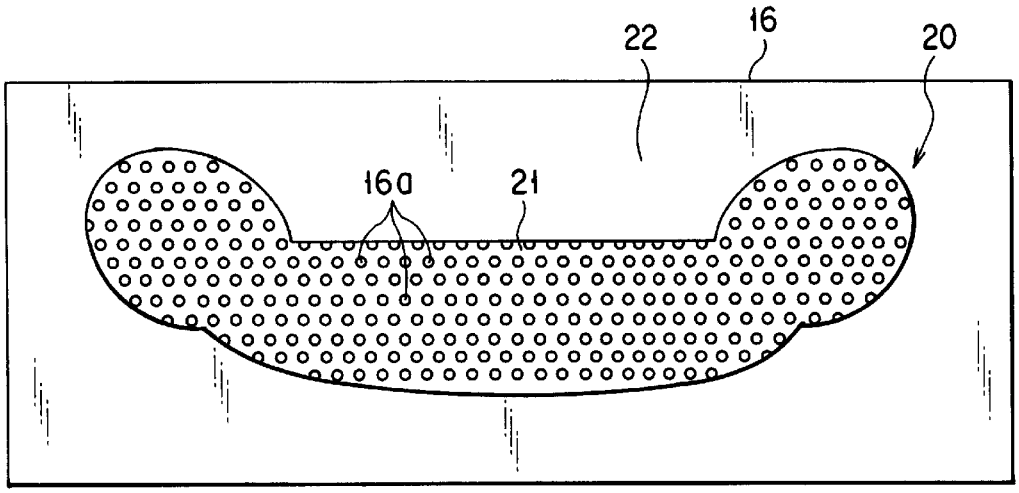
FIG. 5 is a plan view showing the nozzle portion of FIG. 4 fitted with a masking member.
Figure 6:
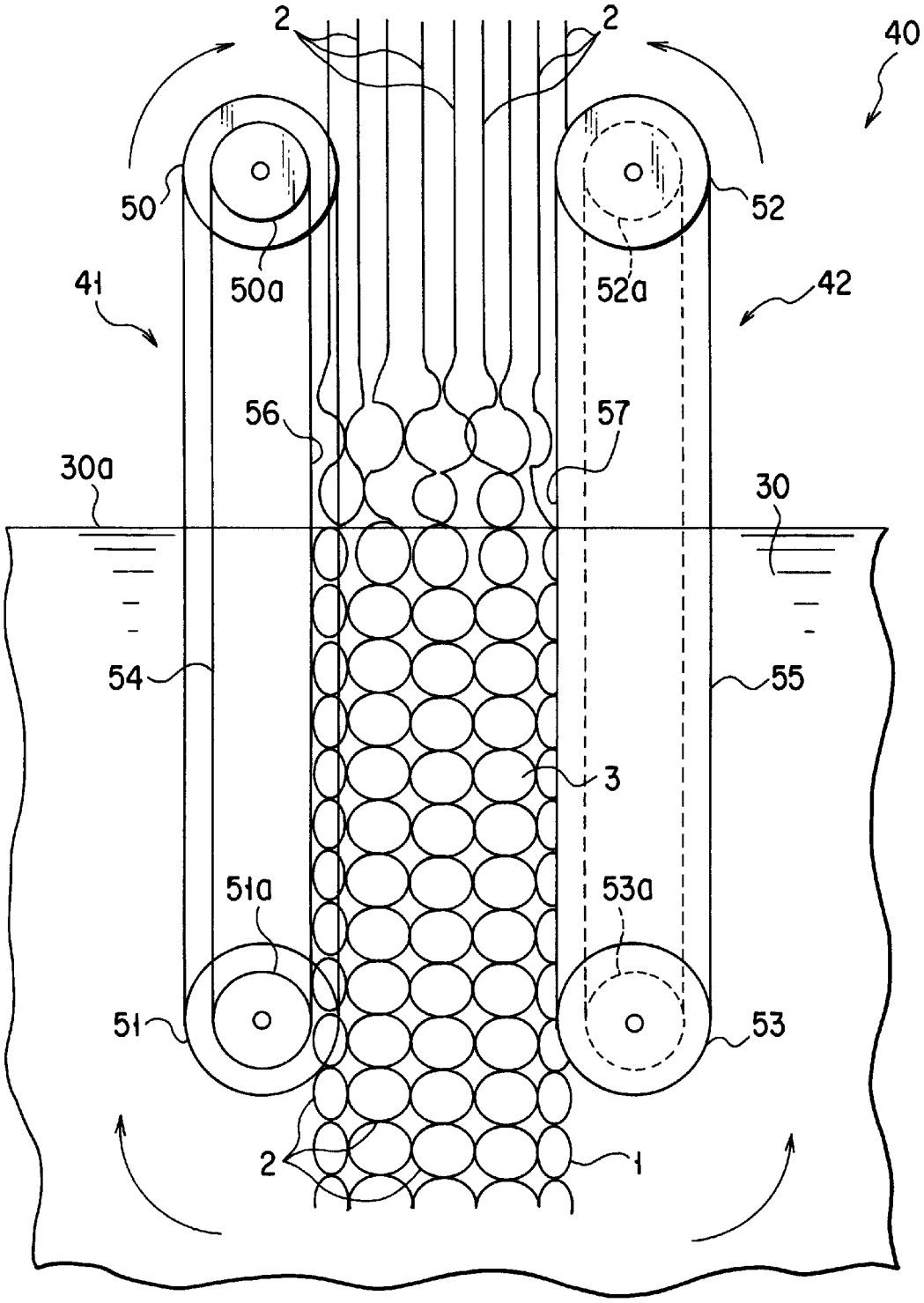
FIG. 6 is a side view of the guide means of the cushion manufacturing apparatus shown in FIG. 3.

As shown in FIG. 4, the nozzle portion 16 has a nozzle effective surface 20 with a given area (e.g., width W: 60 cm, length L: 15 cm). The surface 20 has a large number of nozzles 16*a* with a bore diameter of about 0.5 mm that are arranged at regular pitches (e.g., 5 mm). As shown in FIG. 5, the nozzle portion 16 is fitted with a masking member 22 for use as masking means, which has an aperture 21 shaped corresponding to the outline of the cross section of the cushion member to be formed. The masking member 22 allows only those ones of the nozzles 16*a* which are situated inside a region corresponding to the cross section of the cushion member to open and discharge the molten resin. The extruder 15 can discharge the thermoplastic elastic resin so that the delivery of each nozzle 16*a* ranges from 0.5 g/min to 1.5 g/min.

Underlying the nozzle portion 16, a surface 30*a* of a cooling liquid 30, such as water that serves as cooling means according to the present invention, is situated at a distance of, e.g., 50 cm from the nozzle portion 16. The cooling liquid 30 is heated to a temperature of about 70° C., for example.

Figure 1:
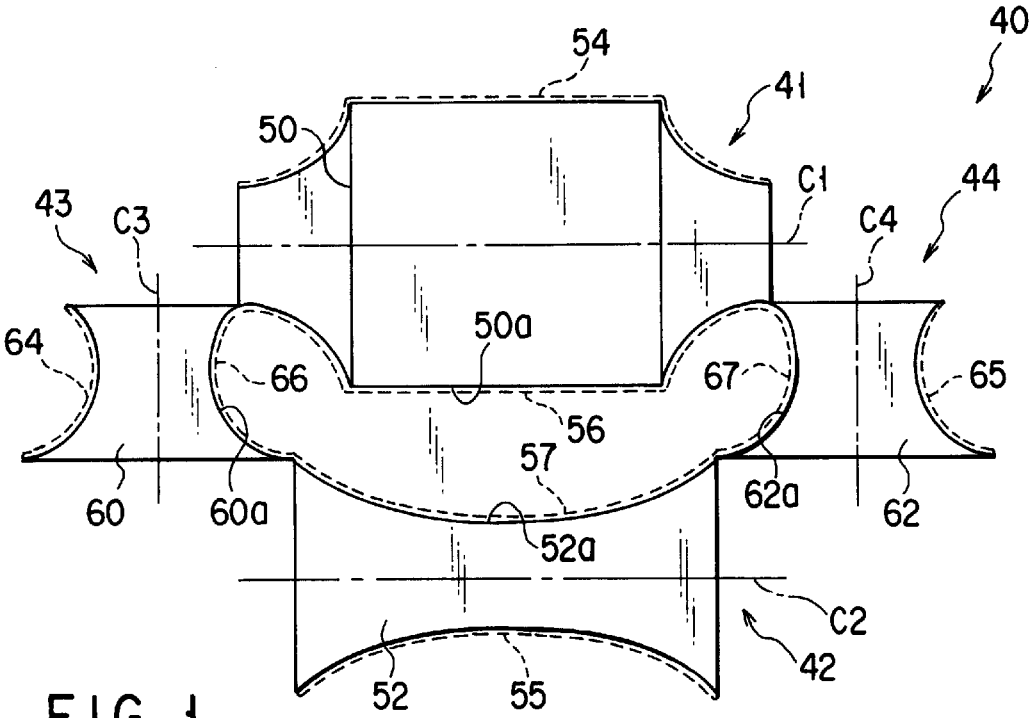
FIG. 1 is a plan view showing rollers constituting guide means of a cushion manufacturing apparatus according to a first embodiment of the present invention.

Guide means 40 underlies the nozzle portion 16. As shown in FIG. 1, the guide means 40 includes a pair of first guide portions 41 and 42, which are opposed to the thickness-direction opposite surfaces 1*a* and 1*b* of the cushion member (e.g., cushion member 1 shown in FIG. 2) to be formed, and a pair of second guide portions 43 and 44, which are opposed to the opposite sides 1*c* and 1*d* of the cushion member 1.

More specifically, the first guide portions 41 and 42 are composed of a plurality of rollers 50, 51, 52 and 53 (shown in FIG. 6), which have projections or recesses corresponding to shape of the cushion member to be formed, a flexible endless belt 54 stretched between the rollers 50 and 51, a flexible endless belt 55 stretched between the rollers 52 and 53, etc.

The rollers 50, 51, 52 and 53 have their respective outer peripheral surfaces 50*a*, 51*a*, 52*a* and 53*a* that are curved corresponding to the outlines of the respective profiles of the thickness-direction opposite surfaces 1*a* and 1*b* of the cushion member 1 to be formed. The one belt 54 runs endlessly between the upper and lower rollers 50 and 51. The other belt 55 runs endlessly between the upper and lower rollers 52 and 53. The belts 54 and 55 can change their shapes depending on the respective shapes of the outer peripheral surfaces 50*a*, 51*a*, 52*a* and 53*a* of the rollers 50, 51, 52 and 53, thereby forming thickness-direction shaping guide surfaces 56 and 57, respectively.

The second guide portions 43 and 44 are composed of upper and lower pairs of recessed rollers 60 and 62 (shown only partially in FIG. 1), a flexible endless belt 64 stretched between the rollers 60, a flexible endless belt 65 stretched between the rollers 62, etc. The rollers 60 and 62 have their respective outer peripheral surfaces 60*a* and 62*a* (shown only partially in FIG. 1) that are curved corresponding to the outlines of the respective profiles of the opposite sides 1*c* and 1*d* of the cushion member 1. As the belts 64 and 65 run endlessly, they change their shapes depending on the respective shapes of the outer peripheral surfaces 60*a* and 62*a* of the rollers 60 and 62, thereby forming opposite side shaping guide surfaces 66 and 67, respectively.

Each of the belts 54, 55, 64 and 65 is formed of a synthetic resin net whose softening point is higher than the continuous filaments 2, for example. Alternatively, however, each belt may be formed of a flexible metal net (e.g., belt width: 70 cm) of stainless steel or the like. The respective upper parts of the belts 54, 55, 64 and 65 are exposed above the surface 30*a* of the cooling liquid 30. The belts 54, 55, 64 and 65 are continuously endlessly run in the directions indicated by arrows in FIG. 3 by means of a drive mechanism that include motors as drive sources. In FIG. 1, C1, C2, C3 and C4 designate the centers of rotation of the rollers 50, 52, 60 and 62, respectively. The centers C1, C2, C3 and C4 need not be on the same level with one another.

The following is a description of processes for manufacturing the cushion member 1 by means of the manufacturing apparatus 10.

The thermoplastic elastic resin material is supplied to the extruder 15 and is softened by being heated to a temperature about 40° C. higher than its softening temperature. The molten resin material is discharged through the nozzles 16a of the nozzle portion 16 and is allowed to fall freely between the belts 54, 55, 64 and 65.

As the molten thermoplastic elastic resin falls between the belts 54, 55, 64 and 65, the continuous filaments 2 as many as the nozzles 16*a* are formed. The filaments 2 are held between the belts 54, 55, 64 and 65 and stay there temporarily, whereupon random winding loops are generated. Thus, the filaments 2 wind without a break as they continuously extend in the direction of arrow A in FIG. 3, thereby forming loops in a direction (e.g., in the direction of arrow B) that crosses the direction of arrow A.

In this case, the nozzles 16*a* are arranged at pitches such that the loops can touch one another. Thus, the loops can be brought into contact with one another between the belts 54, 55, 64 and 65. The three-dimensional network structure 3 can be obtained by bonding the respective contact portions of the loops. Pseudo-crystallization of the network structure 3 can be simultaneously advanced in a manner such that the cooling liquid 30 is kept at the annealing temperature (pseudo-crystallization accelerating temperature) of the structure 3.

The thickness-direction opposite surfaces of the network structure 3, having the loops bonded together, are regulated individually by the respective shaping guide surfaces 56 and 57 of the first guide portions 41 and 42. At the same time, the opposite sides of the structure 3 are put individually inward by the respective shaping guide surfaces 66 and 67 of the second guide portions 43 and 44. As the network structure 3 is shaped in this manner, it is introduced into the cooling liquid 30 at a rate of about one meter per minute, whereupon it is solidify in the liquid 30, and the respective bonded portions of the loops are fixed. Thus, the network structure 3 that has a profile similar to the cross section of the final product of the cushion member 1 is manufactured continuously. As the continuous filaments 2 are looped, the structure 3 is continuously shaped by means of the guide portions 43 and 44. Accordingly, the loops are raised in the thickness direction of the cushion member 1 between the opposite sides 1*c* and 1*d* of the member 1, so that the member 1 can enjoy a good cushioning effect against the seater's load.

In moving the continuous filaments 2 inward by means of the guide means 40, it is advisable to make the distance of width-direction movement by means of the second guide portions 43 and 44 greater than the distance of thickness-direction movement by means of the first guide portions 41 and 42. As this is done, the loops of the continuous filaments 2 are raised in the thickness direction of the cushion member 1 between the opposite sides 1*c* and 1*d* of the member 1, so that the thickness-direction cushioning performance can be further improved.

The network structure 3, manufactured in the series of processes described above, is subjected to pseudo-crystallization at a temperature 10° C. or more lower than the melting point of the thermoplastic elastic resin, if necessary. The resulting network structure 3 is cut to a given size after the pseudo-crystallization, whereupon its shape resembles the final shape of the cushion member 1 shown in FIG. 2. This structure 3 is in the form of a three-dimensional net such that the filaments 2 as many as the nozzles 16*a* form random loops as they continuously extend in the longitudinal direction of the cushion member 1.

The cushion member 1 was cut to a given length (product length) in the longitudinal direction, whereupon the cushion member 1 shown in FIG. 2 was obtained. Further, the member 1 was put into a simple mold that is formed of a punching metal plate, and was subjected to secondary forming such that it was heated by means of hot air of 130° C. to 160° C. and compressed in some measure to obtain the final product shape. After it was cooled, the cushion member 1 was released from the mold. Thus, the cushion member 1 (e.g., with density of 0.04 g/cm$^3$) having the given three-dimensional shape was obtained.

Forming the resulting cushion member 1 took only 5 minutes for the secondary forming, and the product weighed 1,035 g and displayed 25%-compression hardness of 180 N (newton). When the secondary forming time was adjusted to 4 minutes, the product weight was 1,200 g, and the 25%-compression hardness was 190 N. The 25%-compression hardness is a load (reaction force) that is produced when a cushion member is compressed to 25% by means of a disk of 200-mm diameter in a compression test provided by JISK6400 (Japanese Industrial Standards).

A cushion member that was formed without shaping the continuous filaments by means of the second guide portions 43 and 44 weighed 1,000 g and displayed 25%-compression hardness of 180 N. A cushion member that was formed with the continuous filaments moved for 15 mm by means of the guide portions 43 and 44 weighed 1,035 g and displayed 25%-compression hardness of 200 N. A cushion member that was formed with the continuous filaments moved for 30 mm by means of the guide portions 43 and 44 weighed 1,070 g and displayed 25%-compression hardness of 230 N.

On the other hand, a block of a network structure, in the form of a simple cube molded by a prior art method, was heated and compressed in a compression mold so that its volume was halved, whereupon a cushion member as a comparative example was obtained. Forming the cushion member according to this comparative example took 30 minutes, and the resulting cushion member weighed 1,500 g and displayed 25%-compression hardness of 180 N. When this comparative example was formed in 40 minutes, the resulting cushion member weighed 1,700 g and displayed 25%-compression hardness of 190 N. In any case, the prior art cushion member was compressed so much that the apparent density increased considerably.

In the cushion member 1 according to the embodiment of the invention described above, the continuous filaments 2 with 300 deniers or more, which are formed mainly of the thermoplastic elastic resin, are wound to form a large number of random loops. The individual loops are melted and brought into contact with one another so that most of their respective portions are bonded together, thereby forming the three-dimensional network structure 3 having the three-dimensional random loops. If the cushion member 1 is substantially deformed under a heavy stress during use, therefore, the whole network structure 3 absorbs the stress as it is deformed three-dimensionally. If the stress is removed, the structure 3 can be restored to its original shape by means of the elasticity of the thermoplastic elastic resin.

In the cushion member 1 of the invention, moreover, the network structure 3 is composed of the continuous filaments 2 that continuously extend in the longitudinal direction, so that the filaments 2 cannot become loose or be disfigured. Further, no binder is required because the continuous filaments 2 are fused and bonded to one another. Since the cushion member 1 is formed of thermoplastic resin, furthermore, it can be re-fused to be recycled.

Figure 7:
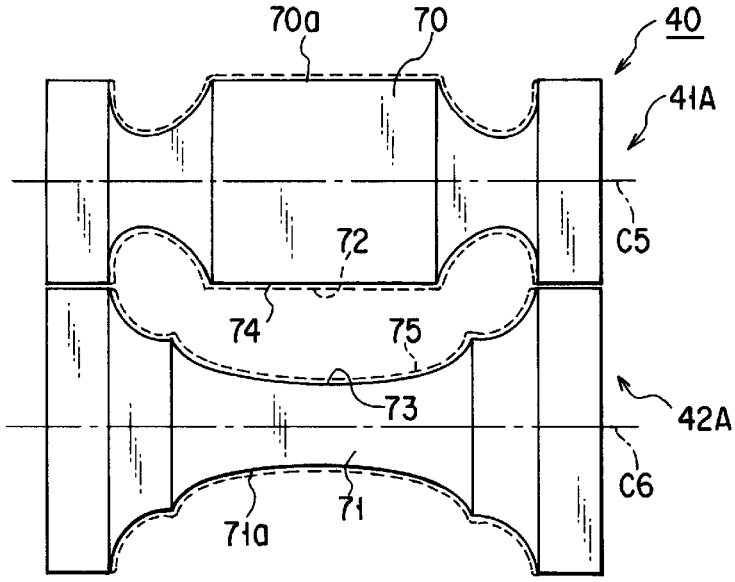
FIG. 7 is a plan view showing rollers of guide means of a cushion manufacturing apparatus according to a second embodiment of the invention.

FIG. 7 shows guide means 40 of a cushion manufacturing apparatus according to a second embodiment of the present invention. The guide means 40 is provided with a pair of guide portions 41A and 42A that are opposed to each other with a formable cushion member (e.g., cushion member 1 shown in FIG. 2) held between them in the thickness direction. For other arrangement, functions, and effects, the second embodiment resembles the first embodiment, so that a description of those particulars is omitted.

The guide portions 41A and 42A according to the second embodiment include a plurality of rollers 70 and 71 (shown only partially in FIG. 7) and belts 74 and 75, respectively. The rollers 70 and 71 have their respective outer peripheral surfaces 70*a* and 71*a* that are shaped so as to surround the thickness-direction opposite surfaces 1*a* and 1*b* and the opposite sides 1*c* and 1*d* of the cushion member 1. The belts 74 and 75 are passed around their corresponding rollers 70 and 71 and run endlessly. As this is done, the belts 74 and 75 change their shapes depending on the respective shapes of the outer peripheral surfaces 70*a* and 71*a* of the rollers 70 and 71, thereby forming shaping guide surfaces 72 and 73, respectively. As the continuous filaments 2 are looped, the guide portions 41A and 42A can also move the cushion member 1 inward from the thickness-direction opposite surfaces 1*a* and 1*b* and the opposite sides 1*c* and 1*d*. In FIG. 7, C5 and C6 designate the centers of rotation of the rollers 70 and 71, respectively. The centers C5 and C6 need not be on the same level with each other.

Figure 8:
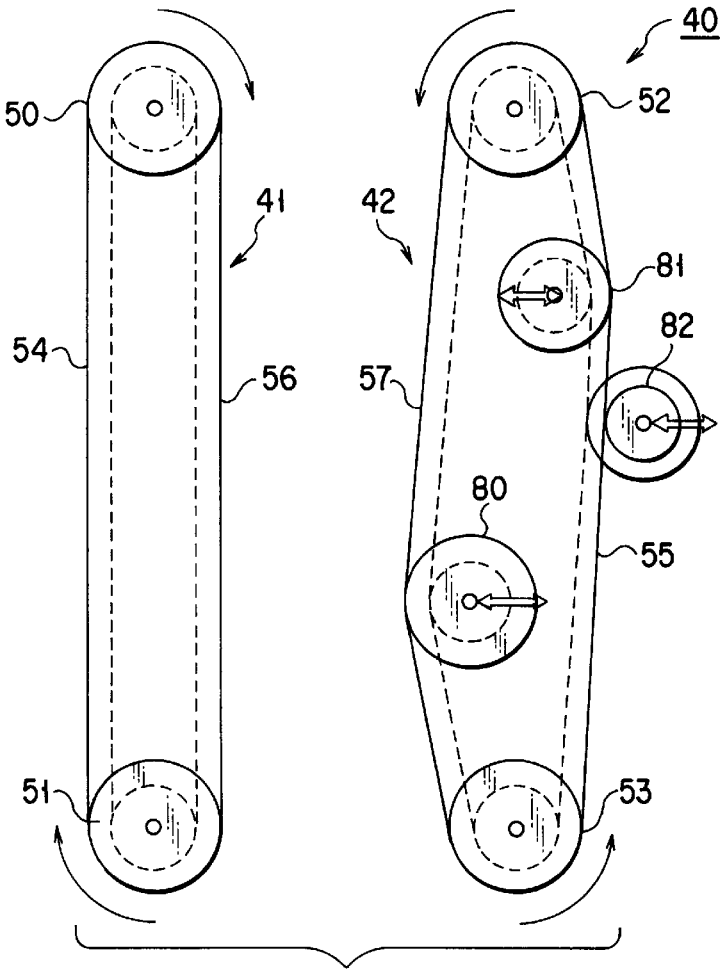
FIG. 8 is a side view of guide means of a cushion manufacturing apparatus according to a third embodiment of the invention.

FIG. 8 shows guide means 40 according to a third embodiment of the present invention. At least one of guide portions 41 and 42 of the guide means 40 is provided with a forming pulley 80 capable of horizontal movement and movable tension pulleys 81 and 82. In the case of this embodiment, the forming pulley 80 is moved depending on the longitudinal shape of a cushion member to be formed while the temperature of the cushion member is within a range for thermal deformation. Thus, the cushion member is moved in the longitudinal direction as it is compressed in its thickness direction by means of the forming pulley 80. Various portions of the cushion member in the longitudinal direction are shaped in this manner.

Figure 9:
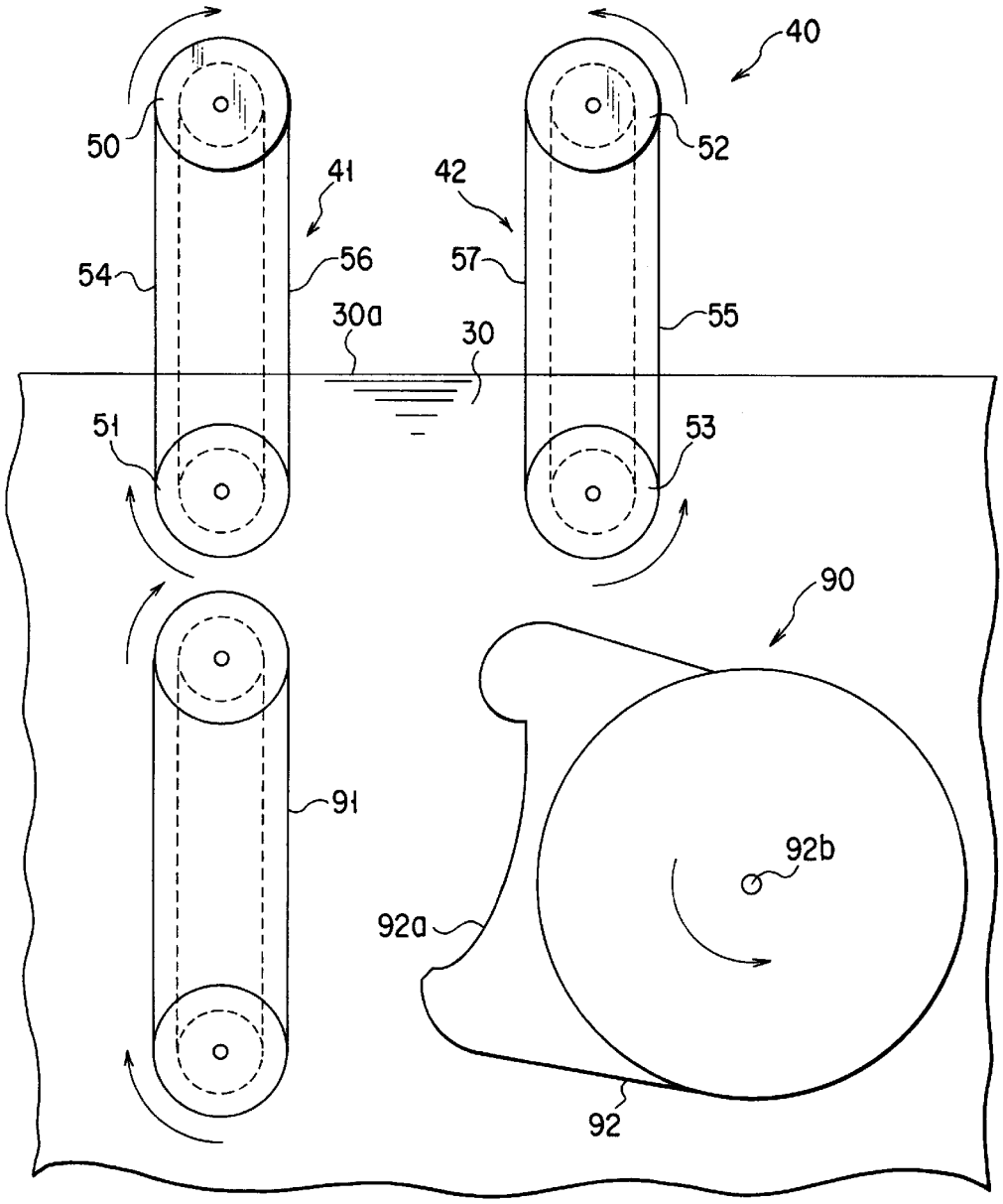
FIG. 9 is a side view showing guide means of a cushion manufacturing apparatus according to a fourth embodiment of the invention and a secondary forming mold.

FIG. 9 shows a cushion manufacturing apparatus according to a fourth embodiment of the present invention. This apparatus is provided with a secondary forming mold 90, which underlies guide means 40. The mold 90 includes a receiving die 91 and a pressure mold 92, which are opposed to the opposite sides of a cushion member that is delivered continuously from the guide means 40. An example of the receiving die 91 is a belt mechanism that combines upper and lower rollers and an endless belt and serves to move the cushion member downward. The pressure mold 92, which has a molding surface 92*a* opposite to the receiving die 91, can rotate around a shaft 92*b*.

The cushion manufacturing apparatus with the secondary forming mold 90 presses the molding surface 92*a* of the pressure mold 92 against the cushion member while the temperature of the cushion member, delivered continuously from the guide means 40, is within the range for thermal deformation. Thus, the cushion member is compressed in some degree and formed additionally (secondary forming for finishing). After this secondary forming operation, the cushion member is cut to the given product length. The receiving die 91 and the pressure mold 92 may be formed of simple molds, such as punching metal molds of an aluminum alloy having a large number of through holes, so that hot air can be blown into the cushion member.

Figure 10:
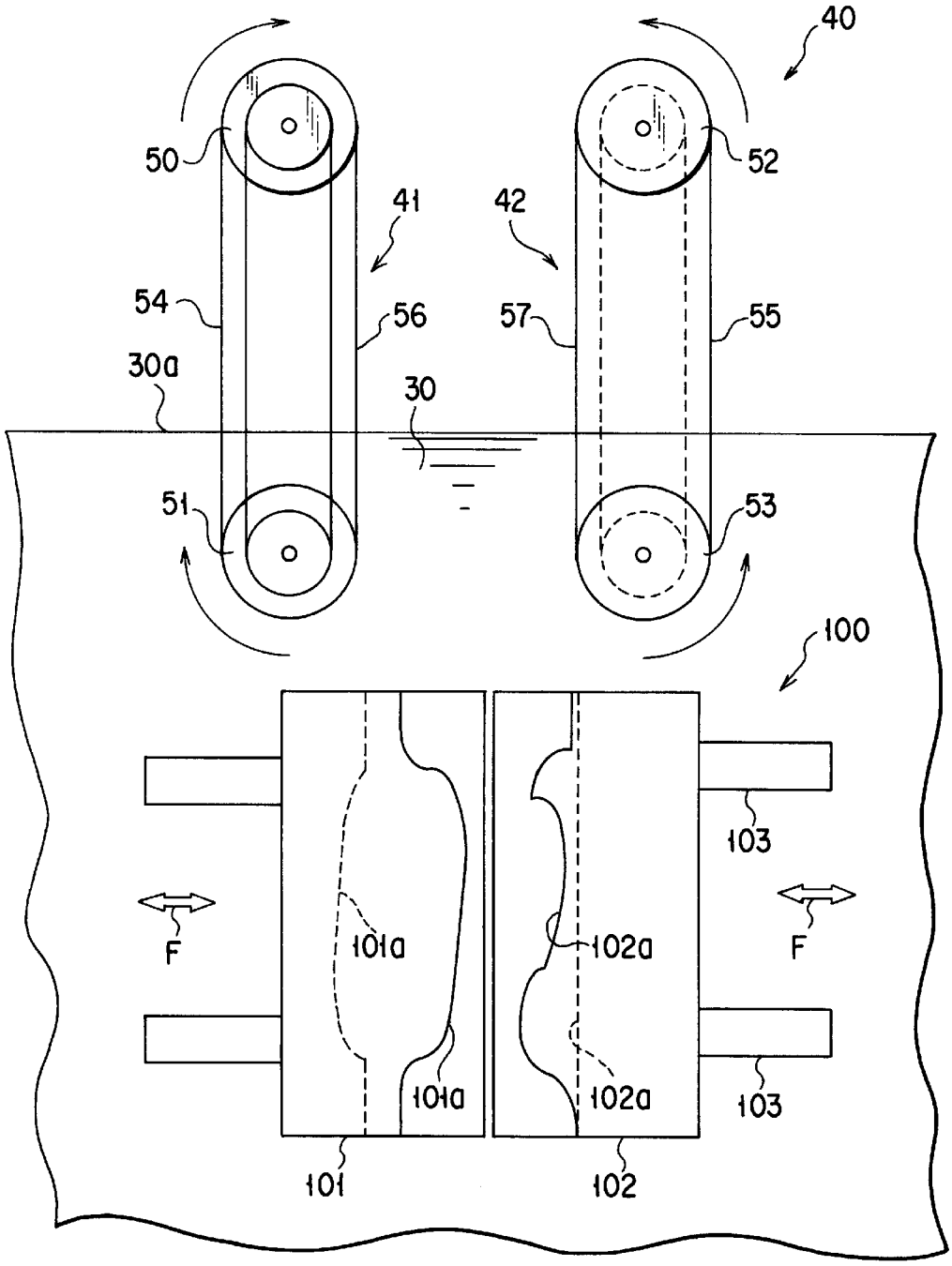
FIG. 10 is a side view showing guide means of a cushion manufacturing apparatus according to a fifth embodiment of the invention and a secondary forming mold.

FIG. 10 shows a cushion manufacturing apparatus according to a fifth embodiment of the present invention. This apparatus is also provided with a secondary forming mold 100, which underlies guide means 40. The mold 100 includes a pair of reciprocating pressure molds 101 and 102, right and left, which can hold a cushion member from the guide means 40 between them. Molding surfaces 101*a* and 102*a* are formed on the opposite faces of the pressure molds 101 and 102, respectively. The surfaces 101*a* and 102*a* have projections and recesses that are shaped corresponding to the respective shapes of various longitudinal parts of the cushion member to be formed.

The pressure molds 101 and 102 can be reciprocated from side to side (in the direction of arrow F) in FIG. 10 by means of a mold drive mechanism (not shown). The cushion member is additionally formed (secondary forming for finishing) in a manner such that the molding surfaces 101*a* and 102*a* of the molds 101 and 102 are pressed against the cushion member that is continuously delivered from the guide means 40 and kept at a temperature within the range for thermal deformation. After this secondary forming operation, the cushion member is cut to the given product length. The pressure molds 101 and 102 may be also formed of simple molds, such as punching metal molds of an aluminum alloy having a large number of through holes.

Figure 11:
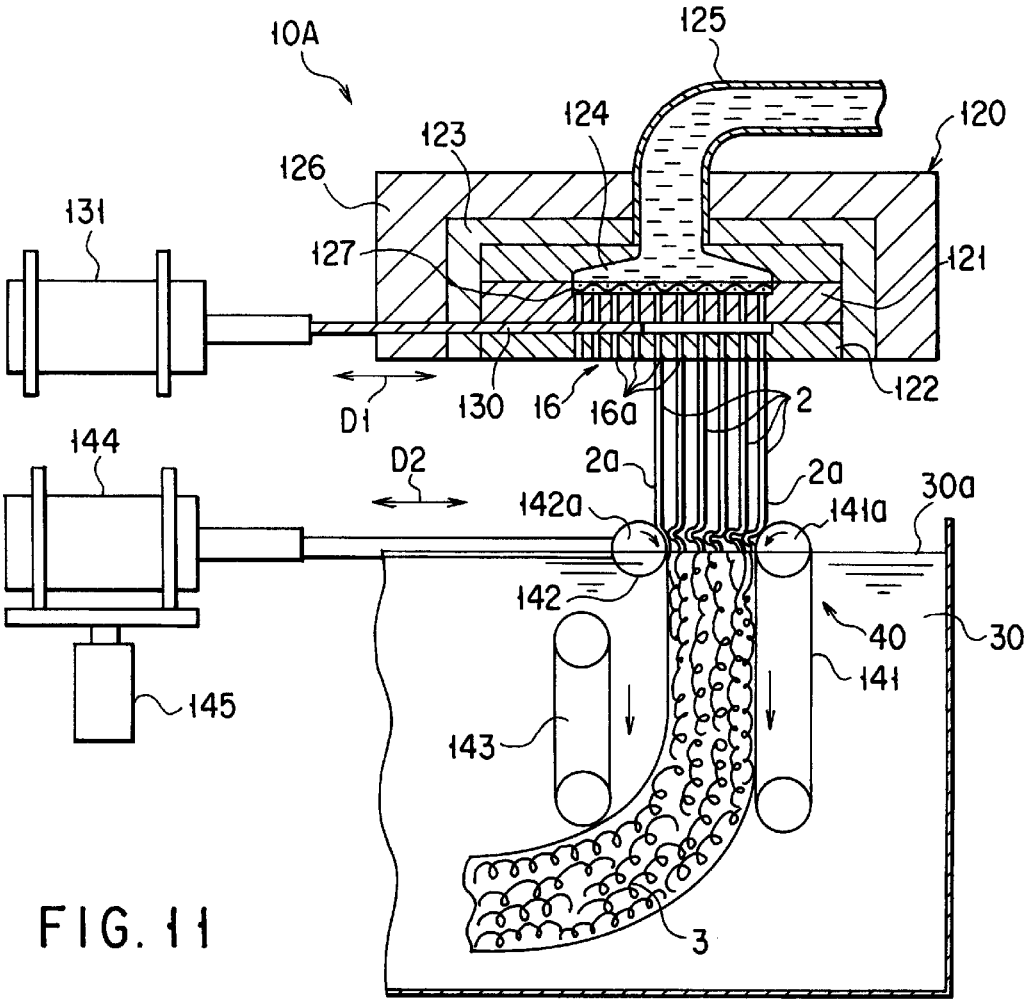
FIG. 11 is a side view, partially in section, showing a cushion manufacturing apparatus according to a sixth embodiment of the invention.
Figure 12:
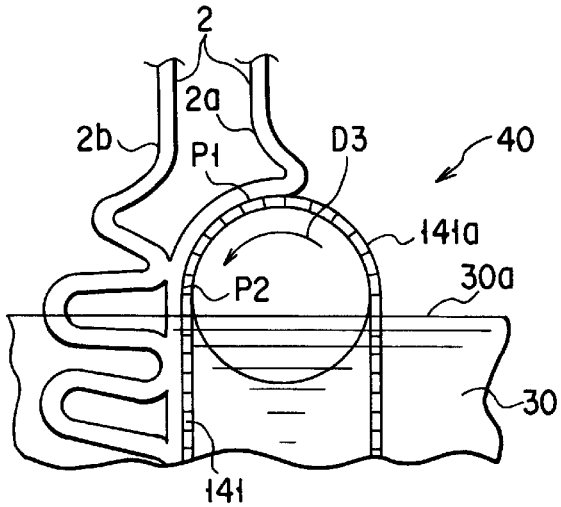
FIG. 12 is an enlarged side view showing a part of the cushion manufacturing apparatus of FIG. 11.
Figure 13:
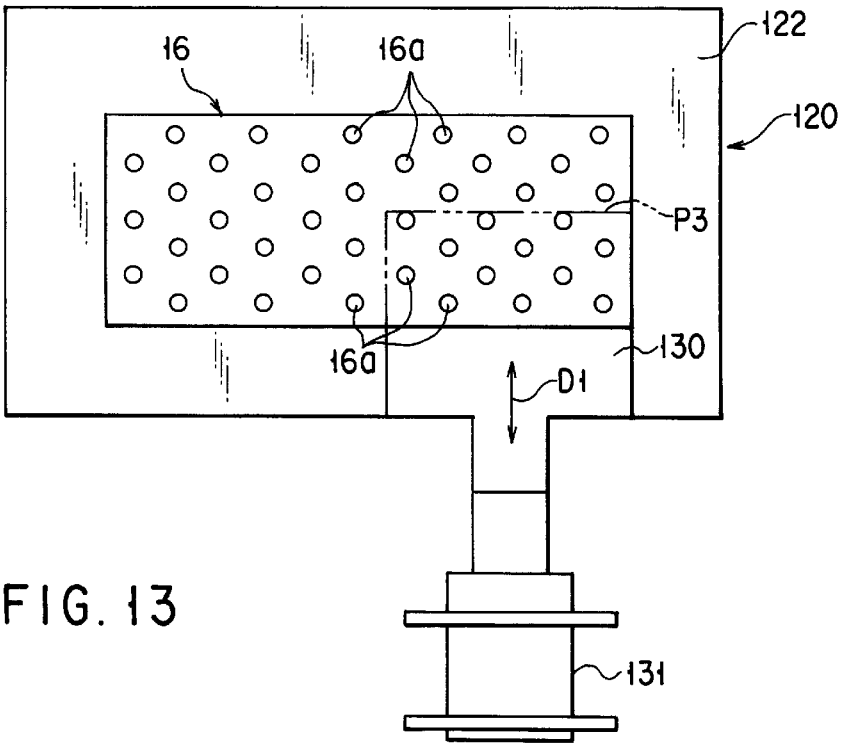
FIG. 13 is a plan view of a nozzle portion of the cushion manufacturing apparatus of FIG. 11.

FIGS. 11 to 13 show a cushion manufacturing apparatus 10A according to a sixth embodiment of the present invention. A die head 120 of the apparatus 10A is provided with nozzle plates 121 and 122 having a large number of nozzles 16*a* each, a heater 123, a pipe 125 through which a molten thermoplastic resin is fed into a chamber 124 in the die head 120, a heat insulator 126, a filter 127, and a movable masking member 130 for use as masking means, etc. The masking member 130 can be moved in the direction of arrow D1 in FIGS. 11 and 13 by means of an actuator 131 such as a cylinder mechanism. As the member 130 is moved in the direction of arrow D1, some of the nozzles 16*a* are masked so that the discharge region of a nozzle portion 16 changes, depending on the shape of a cushion member to be formed. By doing this, the continuous filaments 2 can be discharged only onto necessary portions for the formation of the cushion member.

The nozzle portion 16 is underlain by a cooling liquid 30, a first conveyor 141 including an endless belt for use as guide means 40, and a second conveyor 142 including a movable roller. The second conveyor 142 is underlain by a third conveyor 143 that includes an endless belt. The second conveyor 142, which faces the first conveyor 141, can be reciprocated in synchronism with the masking member 130 in the direction of arrow D2 in FIG. 11 by means of an actuator 144. The first and second conveyors 141 and 142 may be designed so that they can be vertically moved by means of a lift mechanism 145.

An upper end portion 141*a* of the first conveyor 141 and an upper end portion 142*a* of the second conveyor 142 both project above the liquid surface 30*a*. These upper end portions 141*a* and 142*a* are situated in positions such that they can receive outside ones (2*a*) of the continuous filaments 2 that fall from the nozzles 16*a*. The moving speed of each of the conveyors 141, 142 and 143 (at which the network structure 3 is fed) is lower than the falling speed of the filaments 2 that fall from the nozzles 16*a*. Thus, all the filaments 2 stay temporarily between the conveyors 141 and 142 and form loops.

FIG. 12 shows the one conveyor 141 as a representative. As shown in FIG. 12, the outside continuous filaments 2*a* from the nozzle portion 16 touch the upper end portion 141*a* of the conveyor 141 in a position P1 and solidify to some degree. When the upper end portion 141*a* of the conveyor 141 rotates in the direction of arrow D3 in this state, the outside filaments 2*a* move toward softened inside filaments 2*b*. As the outside and inside filaments 2*a* and 2*b* touch one another in a position P2 above the liquid surface 30*a*, they are bonded together. Accordingly, the density of the surface portion of the network structure 3 becomes higher than that of the inner part of the structure 3. In the case of this embodiment, at least those parts of the conveyor end portions 141*a* and 142*a* which extend from P1 to P2 are expected to project above the liquid surface 30*a*.

The surface density of the network structure 3 can be increased by moving the second conveyor 142 toward the first conveyor 141. If the second conveyor 142 is moved away from the first conveyor 141, the surface density of the structure 3 lowers. With use of these conveyors 141 and 142, the surface density of the network structure 3 can be increased, and the ruggedness of the surface can be reduced. The height of the upper end portions 141*a* and 142*a* of the conveyors 141 and 142 above the liquid surface 30*a* may be changed by vertically moving the conveyors 141 and 142 by means of the lift mechanism 145.

Figure 14:
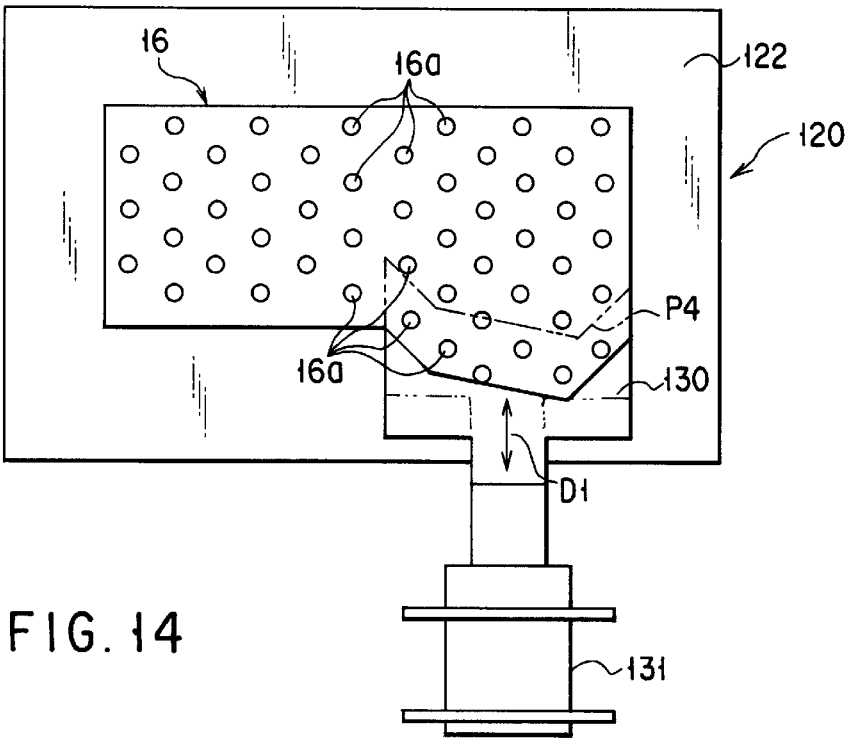
FIG. 14 is a plan view of a nozzle portion of a cushion manufacturing apparatus according to a seventh embodiment of the invention.

A die head 120 according to a seventh embodiment shown in FIG. 14 is provided with a masking member 130 that is shaped corresponding to the shape of a cushion member to be formed. The discharge region of a nozzle portion 16 can be continuously changed by moving the masking member 130 in the direction of arrow D1 by means of an actuator 131.

Figure 15:
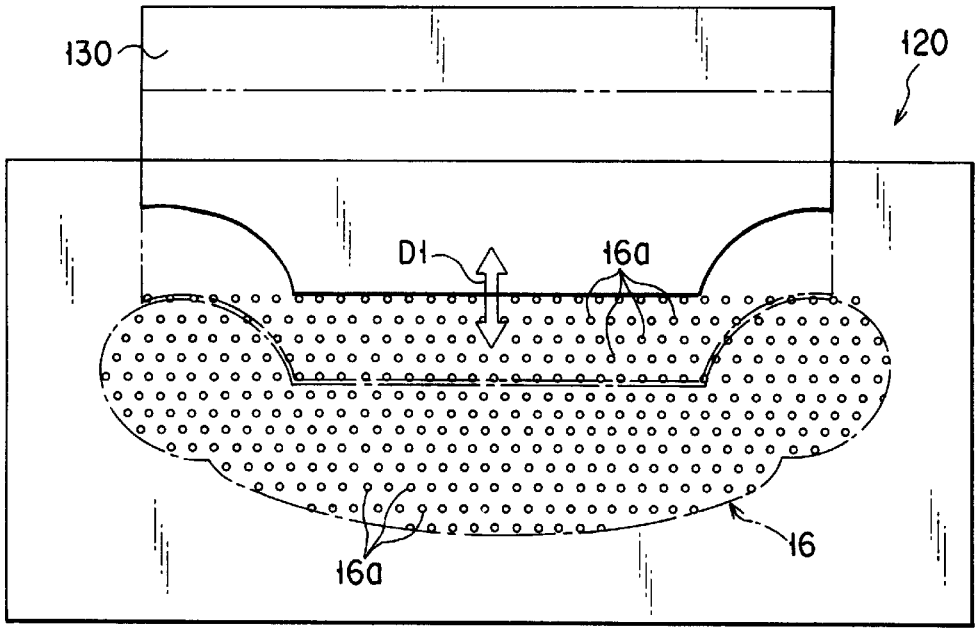
FIG. 15 is a plan view of a nozzle portion of a cushion manufacturing apparatus according to an eighth embodiment of the invention.

A die head 120 according to an eighth embodiment shown in FIG. 15 is provided with a nozzle portion 16, having a discharge region shaped corresponding to the shape of a cushion member to be formed, and a masking member 130 movable in the thickness direction of the cushion member (direction indicated by arrow D1). The discharge region of nozzles 16*a* is changed by moving the masking member 130 in the direction of arrow D1.

Figure 16:
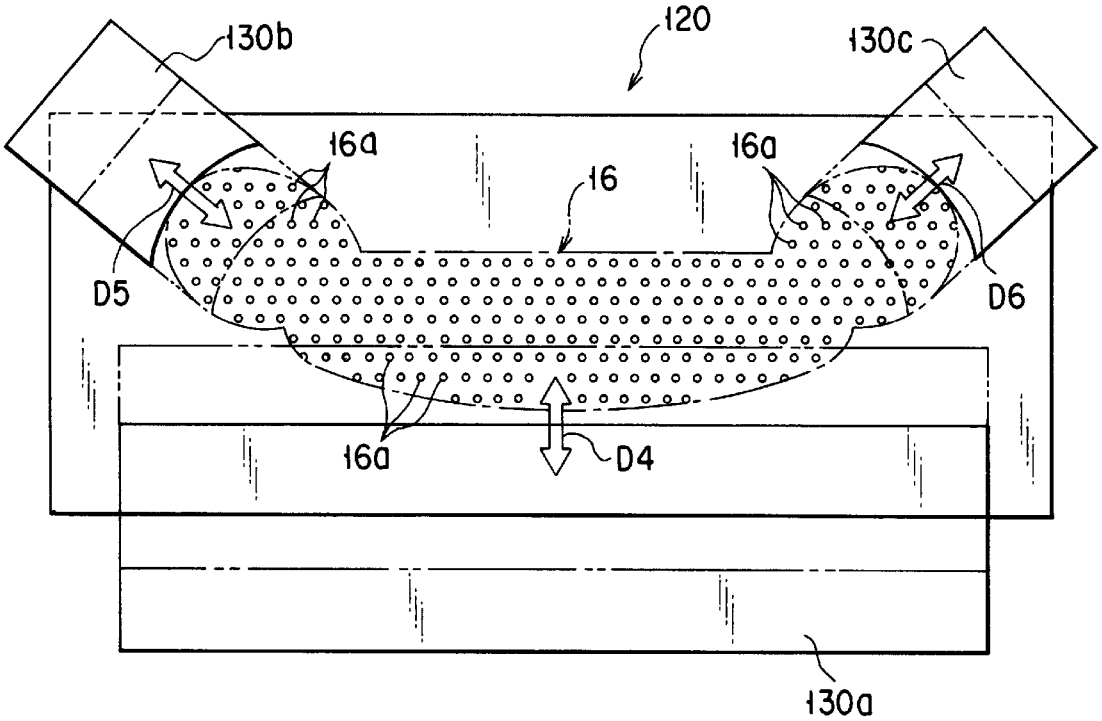
FIG. 16 is a plan view of a nozzle portion of a cushion manufacturing apparatus according to a ninth embodiment of the invention.

A die head 120 according to a ninth embodiment shown in FIG. 16 is provided with a first masking member 130*a* movable in the direction of arrow D4, a second masking member 130*b* movable in the direction of arrow D5, and a third masking member 130*c* movable in the direction of arrow D6. With use of the masking members 130*a*, 130*b* and 130*c* that can continuously move in the different directions, the discharge region of a nozzle portion 16 can be changed more finely.

As the guide means according to the present invention, a fixed guide member, such as a guide plate having curved surfaces (shaping guide surfaces) corresponding to the outline of the profile of the cushion member, may be used in place of the guide means 40 that includes the belt mechanism. The fixed guide member should be declined inward. Alternatively, the guide plate may be combined with the belt mechanism. Further, the guide member may be rotary means, such as a roller that has an outer peripheral surface corresponding to the outline of the profile of the cushion member.

Industrial Applicability

The cushion members according to this invention can be adapted for use in seats of vehicles, such as automobiles, vessels, aircraft, etc., or in some pieces of furniture, such as sofas, beds, etc.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cushion member comprising:

a three-dimensional network structure (3) with an apparent density of 0.005 to 0.20 g/cm$^3$, formed by looping a plurality of continuous filaments (2) of a thermoplastic resin with fineness of 300 to 100,000 deniers and bonding the respective contact portions of the filaments (2), the network structure (3) being solidified in a manner such that the continuous filaments (2) are moved inward from opposite surfaces in the thickness direction of the cushion member (1) to be formed and from opposite sides, depending on the product shape of the cushion member (1), as the continuous filaments (2) are looped, and a density of the opposite surfaces in the thickness direction of the cushion member (1) and a density of surfaces of the opposite sides of the cushion member (1) each becoming higher than that of an inner part of the cushion member (1).

2. A method for manufacturing a cushion member, comprising:

a process for discharging a softened thermoplastic resin through a plurality of nozzles (16*a*), thereby looping a plurality of continuous filaments (2) and bonding the respective contact portions of the filaments (2); and a process for solidifying the continuous filaments (2) in a manner such that the filaments (2) are moved inward from opposite surfaces in the thickness direction of the cushion member (1) to be formed and from opposite sides by means of guide means (40) having shaping guide surfaces (56, 57; 66, 67; 72, 73) corresponding to the outline of the profile of the cushion member (1) as the filaments (2) are looped.

3. A method for manufacturing a cushion member according to claim 2, further comprising a process for additionally forming the cushion member (1) in a manner such that the cushion member (1) is held from both sides thereof by means of a secondary forming mold (90, 100) while the temperature of the cushion member (1), delivered continuously from the guide means (40), is within a range for thermal deformation, and a process for cutting the formed cushion member (1) to a given length.

4. A cushion manufacturing apparatus comprising:

a nozzle portion (16) having a plurality of nozzles (16*a*) for continuously discharging a softened thermoplastic resin, whereby a plurality of continuous filaments (2) discharged from the nozzles (16*a*) are looped with the respective contact portions thereof bonded together;

guide means (40) located under the nozzle portion (16) and having shaping guide surfaces (56, 57; 66, 67; 72, 73) corresponding to the outline of the profile of the cushion member (1) to be formed, the guide means (40) serving to move the continuous filaments (2) inward from opposite surfaces in the thickness direction of the cushion member (1) and from opposite sides as the filaments (2) are looped; and cooling means (30) for cooling the continuous filaments (2), thereby solidifying the same.

5. A cushion manufacturing apparatus according to claim 4, wherein said guide means (40) includes a pair of first guide portions (41, 42) opposed individually to the thickness-direction opposite surfaces of the cushion member (1) to be formed and a pair of second guide members (43, 44) opposed to the opposite sides of the cushion member (1) to be formed, the first and second guide portions (41, 42; 43, 44) including a plurality of rollers (50, 51, 52, 53; 60, 62) individually having outer peripheral surfaces corresponding to the outline of the profile of the cushion member (1) and belts (54, 55; 64, 65) stretched between the rollers and capable of endlessly running to change the respective shapes thereof depending on the respective shapes of the outer peripheral surfaces of the rollers, thereby forming the shaping guide surfaces (56, 57; 66, 67).

6. A cushion manufacturing apparatus according to claim 4, wherein said guide means (40) includes a pair of guide portions (41A, 42A) opposed to each other across the cushion member (1) to be formed, the guide portions (41A, 42A) including a plurality of rollers (70, 71) individually having outer peripheral surfaces surrounding the thickness-direction opposite surfaces and the opposite sides of the cushion member (1) and belts (74, 75) stretched between the rollers (70, 71) and capable of endlessly running to change the respective shapes thereof depending on the respective shapes of the outer peripheral surfaces of the rollers (70, 71), thereby forming the shaping guide surfaces (72, 73).

7. A cushion manufacturing apparatus according to claim 4, wherein said guide means (40) is designed so that the distance of movement of the continuous filaments (2) from the opposite sides is greater than the distance of movement in the thickness direction of the cushion member (1).

8. A cushion manufacturing apparatus according to claim 4, further comprising a secondary forming mold (90, 100) for holding the cushion member (1) from both sides thereof and additionally forming the cushion member (1) while the temperature of the cushion member (1), delivered continuously from the guide means (40), is within a range for thermal deformation.

9. A cushion manufacturing apparatus according to claim 4, wherein said nozzle portion (16) includes masking means (22) for covering some of the nozzles (16*a*) so that the resin is discharged into a region inside the shaping guide surfaces (56, 57; 66, 67; 72, 73) of the guide means (40).

10. A cushion manufacturing apparatus according to claim 4, wherein said nozzle portion (16) includes a masking member (130) capable of changing the discharge region of the nozzle portion (16) by covering some of the nozzles (16*a*).

11. A cushion manufacturing apparatus according to claim 4, wherein said guide means (40) includes a conveyor (142) capable of moving in synchronism with the masking member (130).

12. A cushion manufacturing apparatus according to claim 4, wherein said nozzle portion (16) includes a plurality of masking members (130*a*, 130*b*, 130*c*) movable in different directions and capable of changing the discharge region of the nozzle portion (16) by covering some of the nozzles (16*a*).

13. A cushion manufacturing apparatus according to claim 4, wherein said guide means (40) includes a pair of conveyors (141, 142) opposed to each other and individually having upper end portions (141*a*, 142*a*) adapted to receive outside continuous filaments (2*a*) in a position above the level of the cooling liquid (30) in order to form the surface of the network structure (3), the conveyors (141, 142) serving to move the outside filaments (2*a*) in a direction such that the outside filaments (2*a*) touch inside continuous filaments (2*b*) in a position above the level of the cooling liquid (30).

* * * * *